United States Patent [19]

Hope et al.

[11] 4,190,617

[45] Feb. 26, 1980

[54] MIXING PUMP SYSTEM

[76] Inventors: Henry F. Hope, 3192 Huntingdon Rd., Huntingdon Valley, Pa. 19006; Stephen F. Hope, 2421 Wyandotte Rd., Willow Grove, Pa. 19090

[21] Appl. No.: 931,407

[22] Filed: Aug. 7, 1978

[51] Int. Cl.[2] ..... B01F 7/16; B01F 15/06

[52] U.S. Cl. ..... 261/28; 366/144; 366/165; 366/171

[58] Field of Search ..... 366/144, 165, 274, 306, 366/183, 160, 161, 262, 263, 264, 205, 314, 171; 261/28, 84; 415/120, 189, 190, 182; 222/385; 422/68, 135

[56] References Cited

U.S. PATENT DOCUMENTS

| | | | |
|---|---|---|---|
| 1,789,320 | 1/1931 | Overbury | 366/160 |
| 2,071,393 | 2/1937 | Doherty | 55/193 |
| 2,577,856 | 12/1951 | Nelson | 422/135 |
| 2,847,196 | 8/1958 | Franklin | 366/161 |
| 2,955,924 | 10/1960 | Smith | 422/208 |
| 3,012,977 | 12/1961 | Wilson | 521/172 |
| 3,212,859 | 10/1965 | Mitacek | 261/84 |
| 3,223,486 | 12/1965 | Holl | 422/68 |
| 3,257,174 | 6/1966 | Fournel | 366/306 |
| 3,279,893 | 10/1966 | Sikorski | 422/135 |
| 3,319,937 | 5/1967 | Wilson | 366/172 |
| 3,321,283 | 5/1967 | Ewald | 422/225 |
| 3,343,816 | 9/1967 | Reed | 366/314 |
| 3,376,878 | 4/1968 | Shoemaker | 366/274 |
| 3,737,288 | 6/1973 | Hochman | 422/135 |
| 4,134,736 | 1/1979 | Hammond | 55/199 |

*Primary Examiner*—Robert W. Jenkins

*Attorney, Agent, or Firm*—Weiser, Stapler & Spivak

[57] ABSTRACT

A mixing and pumping system of high efficiency ideally suited for supplying chemical solutions to automatic film developing machines, which supplies the required intimately and uniformly blended mixture of replenishing chemicals, without objectionable exposure to air, and even though these fluids may be inherently difficult to mix, which system generally comprises a cylindrical chamber having near one end a rotating impeller, and an inner cylinder concentric with the chamber which extends to the end of the chamber remote from the impeller and which defines an opening with the chamber at the end nearest the impeller. Fluids are introduced into the annular space separating the inner cylinder and the chamber, the impeller is rotated to alter the fluids at least in the region of the impeller, and the mixed fluids are then passed from within the inner cylinder to the outside of the system.

In automatic film developing machines, the treatment tanks have to be replenished with mixtures of film treatment fluids as these fluids are used up by processing of the films in the machine. The system supplies fresh mixtures as required, directly from separate sources of the mixture ingredients.

The system has wide applications in various industries wherever mixing of fluids is desired.

49 Claims, 11 Drawing Figures

FIG. 1
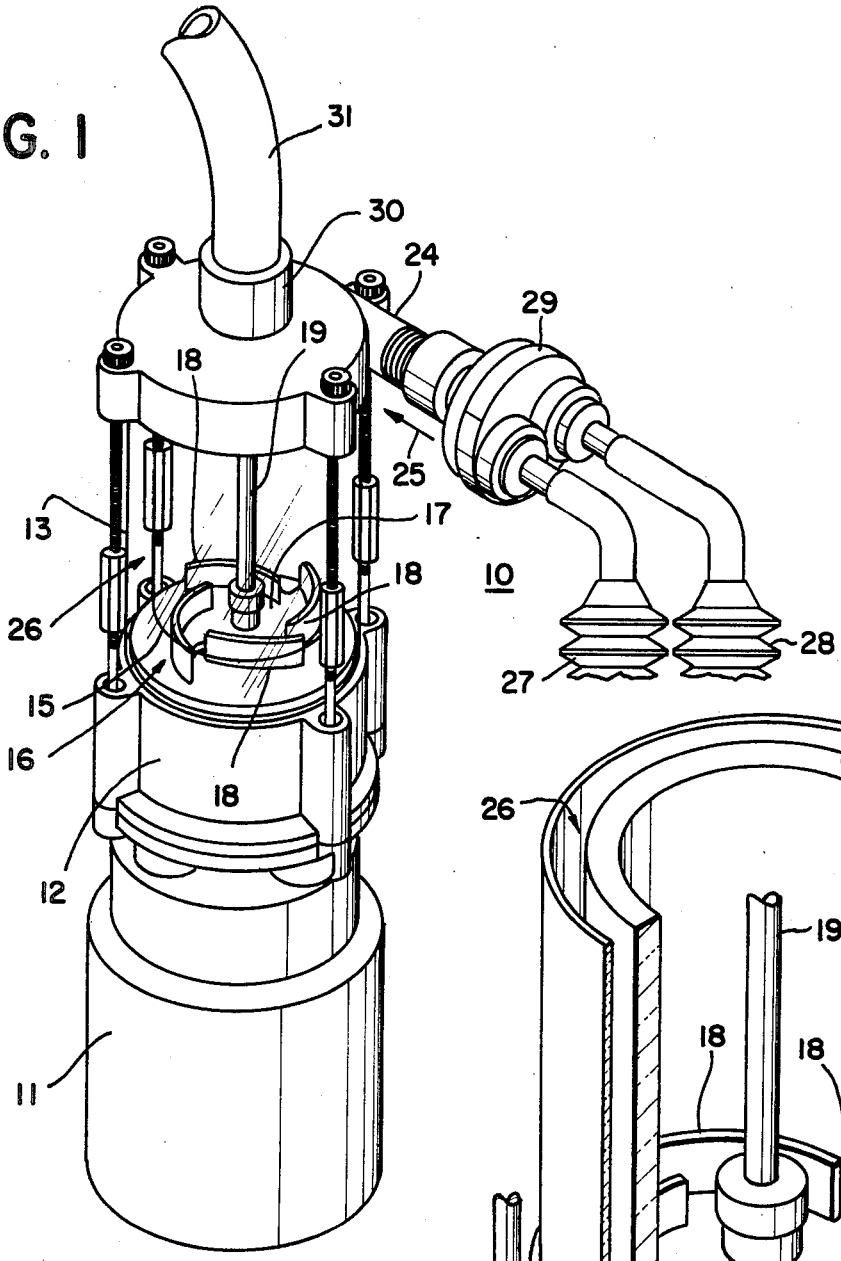
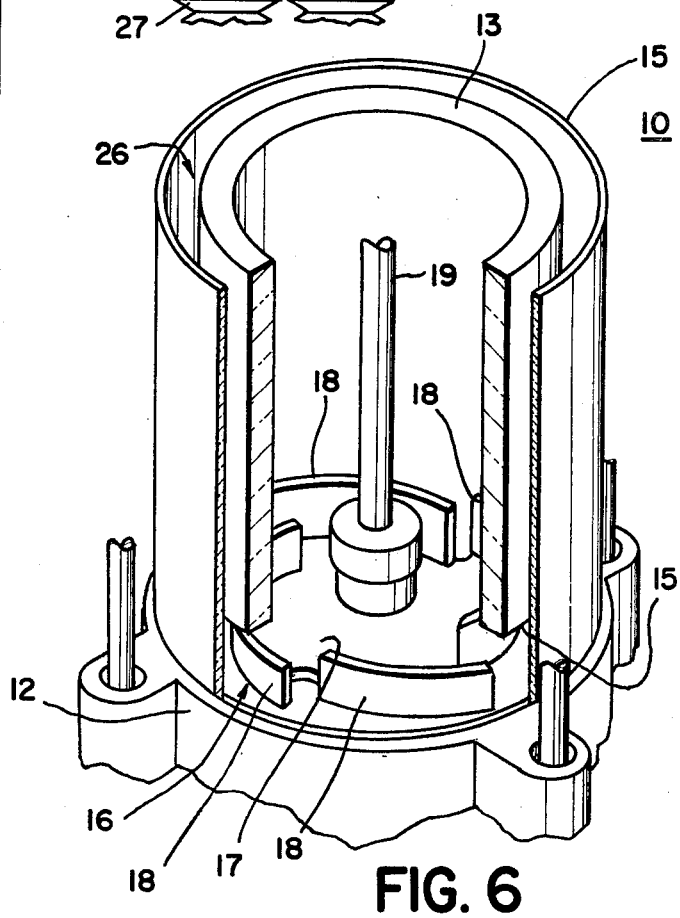
FIG. 6

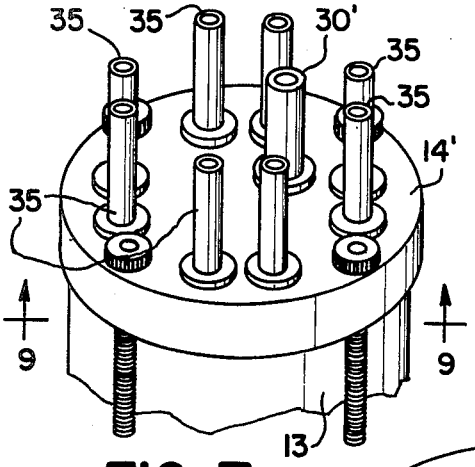
FIG. 7
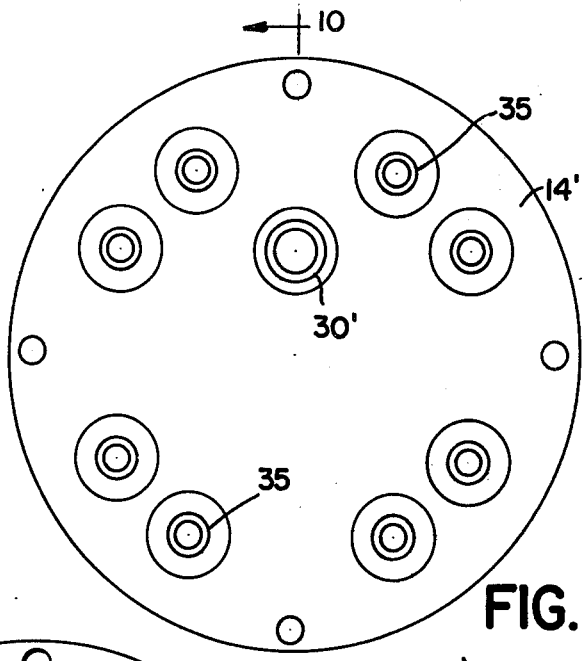
FIG. 8
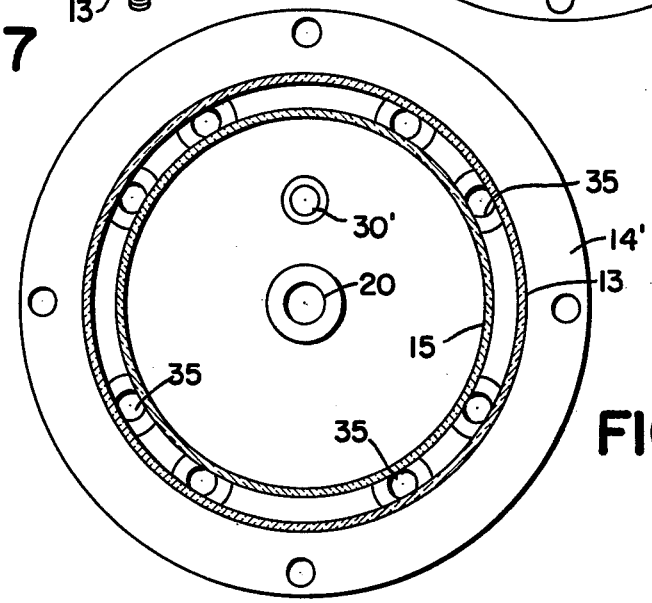
FIG. 9
FIG. 10
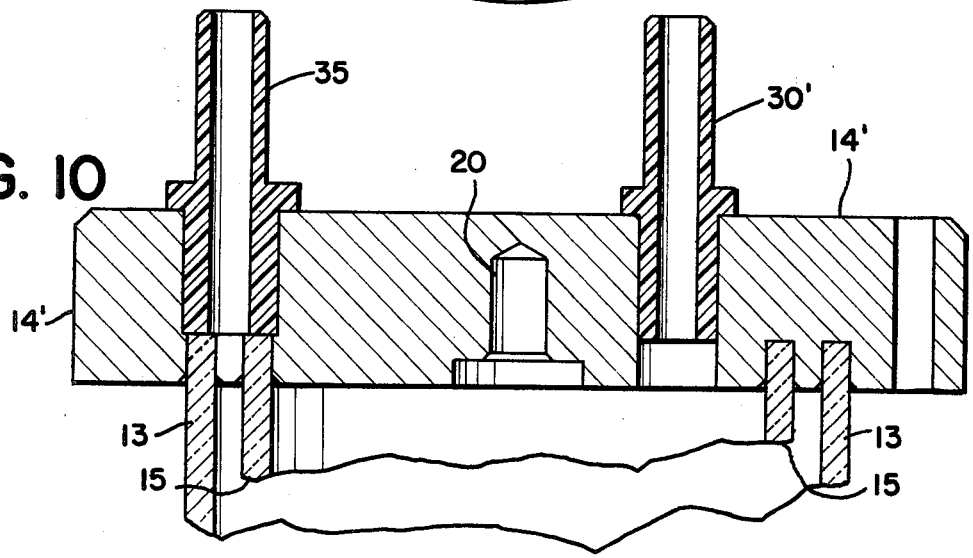

MIXING PUMP SYSTEM

BACKGROUND OF THE INVENTION

In the developing of films such as x-ray and photographic films, it is known to utilize a series of treatment fluids, for developing, fixing, washing, and possibly still other treatment steps.

When automatic machinery is used for such film developing, these treatment fluids are usually placed in a series of tanks, through which the films being developed are then transported, by means of transport roller racks extending down into these tanks.

During operation of such automatic film developing machines the fluids in the tanks gradually become depleted, and must therefore be replenished. Generally, the treatment fluid in any given tank consists of a mixture of chemicals and water. For proper replenishment, there must be maintained not only the overall fluid level in the tank, but also the relative concentration of the chemicals. This replenishing requirement has heretofore not been completely satisfactorily met. The prevailing technique for replenishing involves pouring the replenisher ingredients—the chemicals—into a container, stirring these chemicals in the container, and then pouring the resultant mixture into the tank, in quantities and at intervals such as to maintain in the tank the desired level and proportions of chemicals.

It is known to automate certain aspects of this technique. For example, our prior U.S. Pat. No. 3,752,052, issued Aug. 14, 1973, teaches automatic control of a pump which delivers replenisher fluid to the machine treatment tank as needed.

What is not disclosed in this prior patent is how to obtain initially the correct replenisher fluid mixture, which the pump can then automatically deliver to the developing machine.

There are a wide variety of mixtures which are used for replenishment in film developing. For example, a replenisher for the developer fluid may consist of a developing agent (such as sold by Kodak under the commercial name Elon), anhydrous sodium sulfite, monohydrate sodium carbonate, and sodium hydroxide in aqueous solution.

Many other ingredients and proportions are possible.

Although for some of these mixtures the chemicals are available from manufacturers in premixed form, these are generally impractical for modern, high-speed automatic developing machines because of the high cost of such premixed chemicals. As a practical matter it is therefore necessary to acquire the individual chemicals in separate bulk containers, and to mix them at the site of the machine. In any event, the water is admixed on site since it determines the concentration of the final replenisher mixture, which must be adjusted locally in accordance with current operating conditions.

This on-site mixing, by the prevailing technique previously described, is accompanied by undesirable side effects.

There is fluid waste in pouring into and out of the container in which the mixing is performed. Some of the fluids used are quite "messy", leading to unsightly premises where the mixing takes place and sometimes even to conditions which are potentially hazardous to health and property.

The mixture itself suffered from the fact that the ingredients are generally quite difficult to blend homogeneously and uniformly unless vigorously stirred.

Moreover, this stirring sometimes had to be repeated at frequent intervals to overcome the tendency of the chemicals to reseparate. This in turn further accentuated the other problems of spillage previously described.

Finally, over a period of time the chemicals of the replenisher mixtures may react with each other, and/or may be oxidized by the air which has access into the mixture both during the stirring and also later, as portions of the mixture in the container are gradually emptied into the machine. This caused deterioration of the replenisher mixtures formed by the prevailing technique under discussion.

While these problems occur primarily in the film developing industries, in other industries, typically chemical or biochemical, where the system of the invention can also be used, as explained hereinafter, similar difficult problems exist caused by the lack of equipment capable of mixing or blending difficult to mix components.

SUMMARY OF THE INVENTION

We have now found that an appreciable improvement can be made in the replenishment of chemicals used in automatic film developing machines by means of a unique system which automatically mixes the fluids to be used in replenishing a particular developing machine tank, and pumps these mixed fluids toward their intended destination, like tanks or other containers.

In the system of the invention, the mixing is performed under conditions of fluid movement and pressure which are particularly conducive to intimate, uniform mixing of hard-to-mix fluids.

Air may be excluded so that no oxidation of the fluids takes place.

Pumping movement may be continued while the mixing takes place.

The system can be completely closed, from the original bulk containers for the separate ingredients, up to discharge of the mixture into the developing machine tank. Yet due to the transparent nature of the plastics of the chamber, the operation can be observed as desired.

The system of the invention includes a cylindrical chamber which houses at one end a curved-vane impeller rotatable in the manner of the impeller of a centrifugal pump. Concentric within the chamber is an inner cylinder which stops near the impeller at one end, but extends fully to the end of the chamber at the other. In operation, the fluids to be processed are introduced under pressure into the annular space between the inner cylinder and the outer chamber wall. They flow downwardly, entering the inner cylinder in the region around the impeller. In this flow, they encounter the rotating impeller and are urged by it back toward the outer chamber wall. The inward-urging pressure under which the fluids are introduced is so proportioned relative to the outward-urging force exerted by the impeller that there is a net flow of the fluids past the impeller into the inner chamber. However, the local agitation to which these fluids are subjected by the impeller during such passage has been found to provide excellent mixing for the fluids.

The fluids then continue to flow through the inner cylinder and out of an outlet at its end remote from the impeller. This outlet may be connected directly to the particular developing machine tank for which the mixture is intended.

In the mixing system of the invention, there prevail motions which are conductive to optimum mixing. The liquids are forced within the confines of the outer annular chamber, assisted by gravity flow, when the system is positioned as illustrated in FIG. 1. This flow of the liquids from the inlet at the top of the cylinder towards the bottom causes an initial contacting of the liquids.

The impeller creates and maintains yet other flow patterns. Due to its position and shape there is established a flow pattern having a rotary, swiveling motion. Also a flow pattern is created which radiates towards the wall of the outer cylinder while simultaneously being channeled between the blades of the impeller inwardly into the inner cylinder. Thus a certain hydraulic shearing action is created. The fluids in motion are also forced toward the inside of the inner cylinder where, due to the pressure under which the liquids are introduced into the cylinder chamber, the liquids ascend in the inner cylinder toward the outlet.

A review of the mixing literature emphasizes that mixing or blending systems which create several flow patterns are those which are most efficient for achieving what is intended. What is noteworthy is that in the mixing system of the invention, there is provided a downward and an upward flow, which flows are separated between the outer and inner cylinders respectively. Also noteworthy is that the mixing can be regulated not only by regulating the rotary speed of the impeller blades but also by regulating the speed of the inlet and outlet flows, thus allowing for optimum residence time of the chemicals in the system depending on the liquids to be mixed.

In the mixing system of the invention the impellers, though shown as fixed members, can be constructed to be movable to any desired position, permitting adjustment of their angle with respect to the walls of the system as is deemed best.

If desired, baffles can be positioned on the walls of the inner (or of the outer) cylinder, but such satisfactory mixing is accomplished without baffles that such would seem superfluous. Likewise, if desired, blades can be positioned at various points along the axis of the impeller.

The mixing system of the invention presents an unusual combination capable of providing highly effective mixing due to the unique construction of the system which creates circular, axial and other flow patterns, including downward and upward flows, all of which are conducive to maximum mixing.

Also noteworthy is that in the vicinity of the impeller blades, where the two cylinders communicate, these various flow patterns prevail concurrently, maximizing blending conditions. Accordingly, the mixing system of the invention is useful in mixing any fluids, especially hard to mix fluids in the chemical, biochemical, food and related industries.

The mixing system of the invention can be used for blending viscous materials, pastes, gel mixes like elastomers, plastics, polymers, heavy solutions or dispersions, lacquers, paints, adhesives, inks, resin solutions, soaps, components in the food industry such as oleomargerine, dyes, oils, and whereever it is desired to disperse, dissolve or mix materials in the drug, cosmetic or other industries.

The above-mentioned dispersions can be fluid in fluid dispersions, in contrast to solutions, or solids in liquids (with proper adjustment being made to the inlet and outlet if necessary). Such solids can be made to dissolve during mixing in the apparatus of the invention.

The mixing system can be used where gases are to be excluded from the liquids, such as when it is desired to avoid oxidation of the components.

On the other hand, the system can be made to admit controlled amounts of desired gases, one example being hydrogen when selected hydrogenation under even and maximum blending is called for.

It is apparent that the apparatus is highly versatile.

As illustrated, the walls of the cylinders are ideally constructed of transparent or translucent plastics to permit easy observation of the interior of the mixing system.

If desired cooling or heating means can be made to heat or cool the fluids at any time during the operation.

Other advantages and applications of the system of the invention will become readily apparent to one skilled in the art from the description which follows.

The means which supplies the fluids under pressure preferably does so in a pulsating manner. This may be accomplished, for example, by bellows-type pumps such as taught in our U.S. Pat. No. 3,965,758, issued June 27, 1976. Together with the action of the impeller, this creates a pulsating effect of alternate compression and decompression within the cylindrical chamber which further enhances the quality of the mixing action.

Accordingly, it is a primary object of the invention to provide an improved system for replenishing automatic film developing machines.

It is another object to provide such a system which accomplishes improved mixing of the film treatment fluids.

It is another object to provide such a system which accomplishes mixing at the same time as pumping.

It is another object to provide such a system which continuously supplies a mixture of fluids directly from the containers in which the separate fluids are commercially available.

A fuller understanding of the invention will be had by referring to the following description of the preferred embodiments thereof, taken in conjunction with the accompanying drawings, wherein like reference characters refer to similar parts throughout the several views in which:

BRIEF DESCRIPTION OF THE DRAWINGS

FIG. 1 is an overall isometric view of a mixing and pumping system embodying the invention;

FIG. 6 is a cross-sectional top view of the apparatus of FIG. 4 taken along line 5—5;

FIG. 7 is a partial isometric view of the mixing and pumping system showing an alternative lid construction;

FIG. 8 is a top plan view of the alternative lid construction illustrated in FIG. 7;

FIG. 9 is a cross-sectional view of the mixing and pumping system of FIG. 7 taken along line 9—9; and FIG. 10 is a sectional view of the alternative lid construction of FIG. 8 taken along line 10—10;

DESCRIPTION OF THE PREFERRED EMBODIMENT OF THE INVENTION

Figure 2:
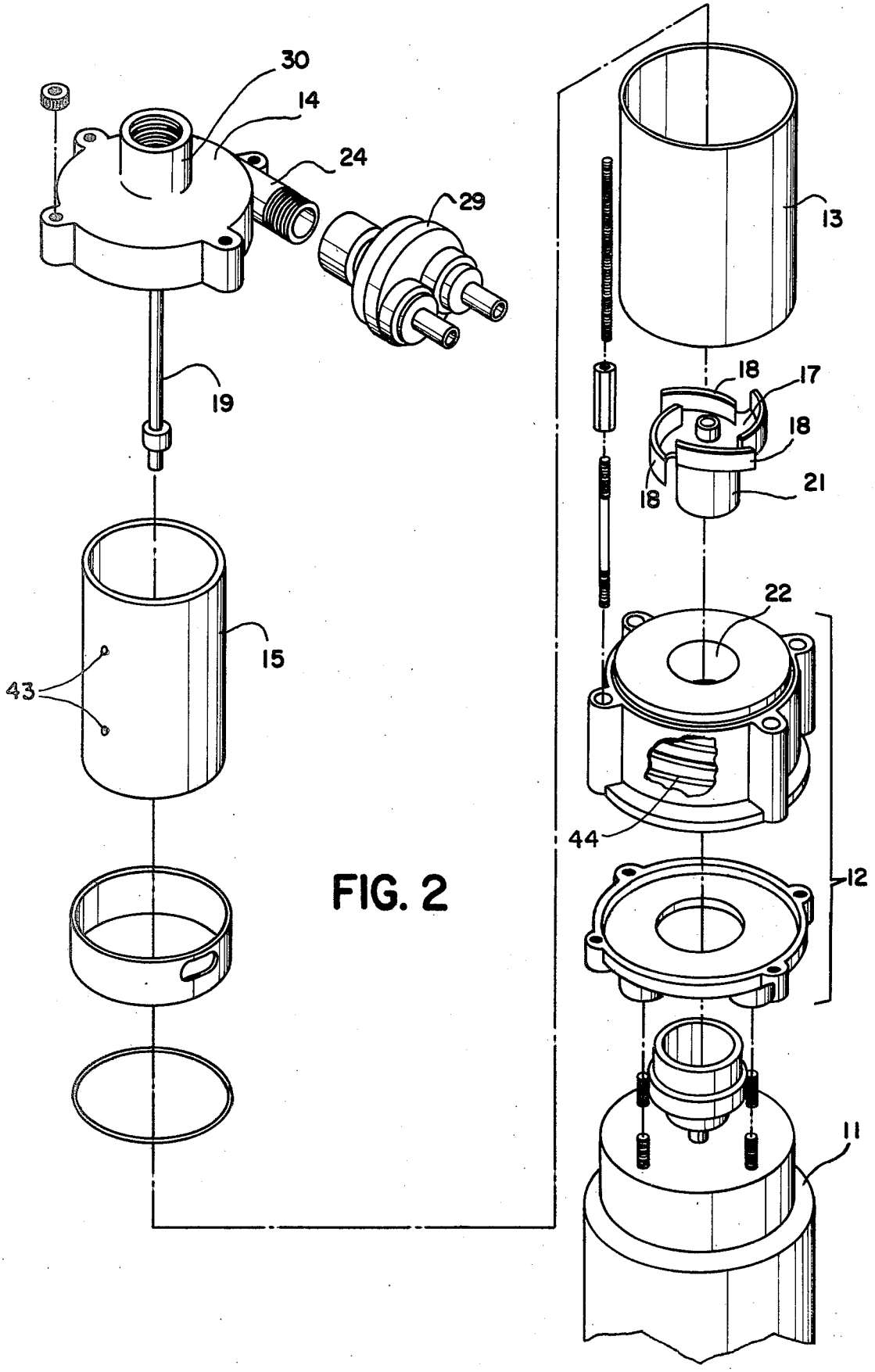
FIG. 2 is a partial, isometric view of that area of the mixing and pumping system which is in the vicinity of the impeller and the blades, partially broken away to show structural detail.

Referring now to the drawings, these show an assembly 10 which include an electric motor 11. Attached to the housing of motor 11, is a base 12 upon which is supported a cylinder 13. At the end of cylinder 13 remote from base 12 there is a lid structure 14 which closes that end of cylinder 12. The base 12, cylinder 13 and lid 14 define an enclosed cylindrical chamber.

Within cylinder 13 there is an inner cylinder 15, of lesser diameter than cylinder 13. This inner cylinder 15 terminates at the same lid 14 as does cylinder 13. On the other hand, the end of inner cylinder 15 nearest the base 12 does not extend all the way to that base, but stops short, so that this end of inner cylinder 15 remains free, spaced from base 12 by a gap 16. Positioned concentrically with respect to both cylinders 13, 15 is an impeller 17 having curved, outwardly extending blades 18 (see particularly FIG. 5).

Figure 5:
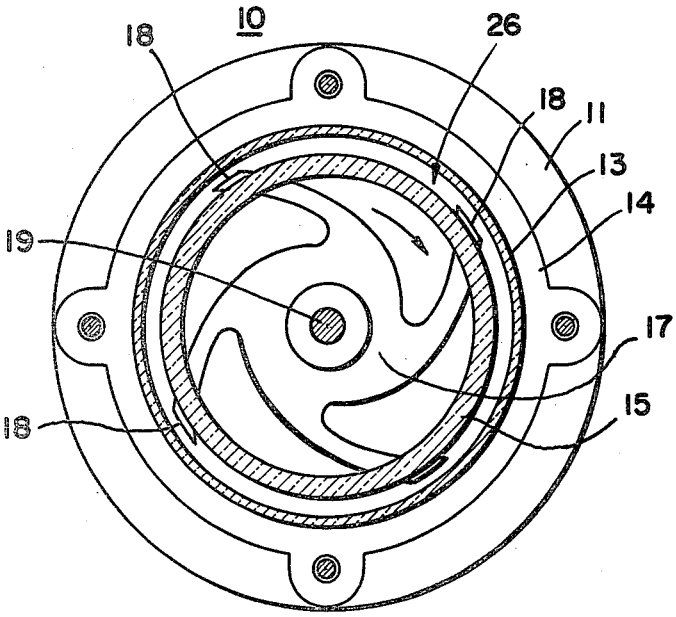
FIG. 5 is a cross-sectional top view of the apparatus of FIG. 4 taken along line 4—4.
Figure 11:
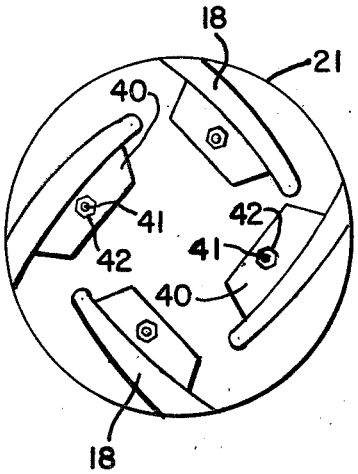
FIG. 11 is a top plan view of an alternative embodiment of the impeller of the mixing and pumping system.

The blades 18 are preferably substantially equal in length, extending outwardly in a convex, radially symetrical manner. The blades 18 are also preferably placed askew from the radial axis of the impeller 17. The resulting configuration generally causes the blades 18 to radially overlap as illustrated in FIG. 5. It is also possible to provide blades 18 the position of which are adjustable, to accommodate varying applications by varying the above parameters as necessary, as illustrated in FIG. 11. For example, this may be accomplished using blades 18 having flanges 40 which are adjustably attached to impeller 21 by studs 41 and bolts 42. Other means are possible which will produce a similar result.

The diameter of the impeller 17 (with its blades 18) is preferably such that the tips of the blades extend approximately to the perimeter of the inner cylinder 15. Such an impeller 17 would be positioned adjacent base 12 having an axial dimension such that the impeller blades 18 nearly but not quite fill the gap 16 between base 12 and the free end of inner cylinder 15. The blades 18 could also extend upwardly at a distance greater than the gap 16 if desired. It is also possible, when the impeller blades are dimensioned so as not to fill the gap 16, to utilize an impeller 17 which extends radially to, or even beyond, the perimeter of the inner cylinder 15, if desired.

A shaft 19 extends upwardly from impeller 17 to a bearing 20 (best visible in FIG. 3) within which the shaft 19 is journaled for rotation. The lower end of impeller 17 is formed by a cylindrical extension 21 which fits into a corresponding, although slightly wider recess 22 within base 12. In the bottom of recess 22 there is provided a bearing 23 which journals extension 21 for rotation within recess 22.

When the electric motor 11 rotates, its shaft produces rotation of a set of magnets peripherally surrounding the recess 22 within base 12. With extension 21 there are corresponding magnets. As a result, when the motor 11 rotates, magnetic coupling causes extension 21 to likewise rotate essentially in unison with the rotation of the motor. This imparts corresponding rotation to impeller 17.

Figure 3:
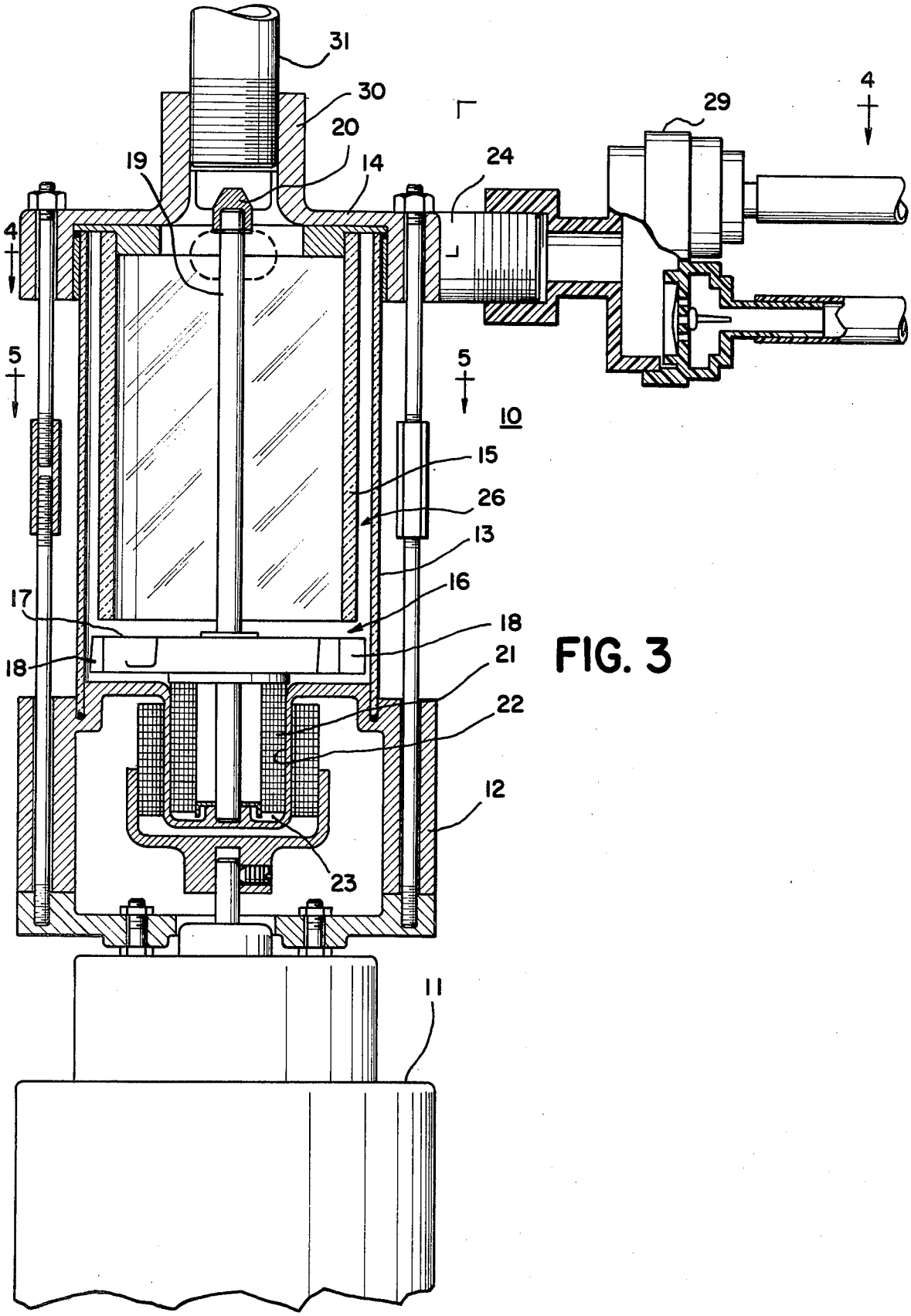
FIG. 3 is an exploded view of the mixing and pumping system showing particularly the components which comprise the mixing portion of the system.
Figure 4:
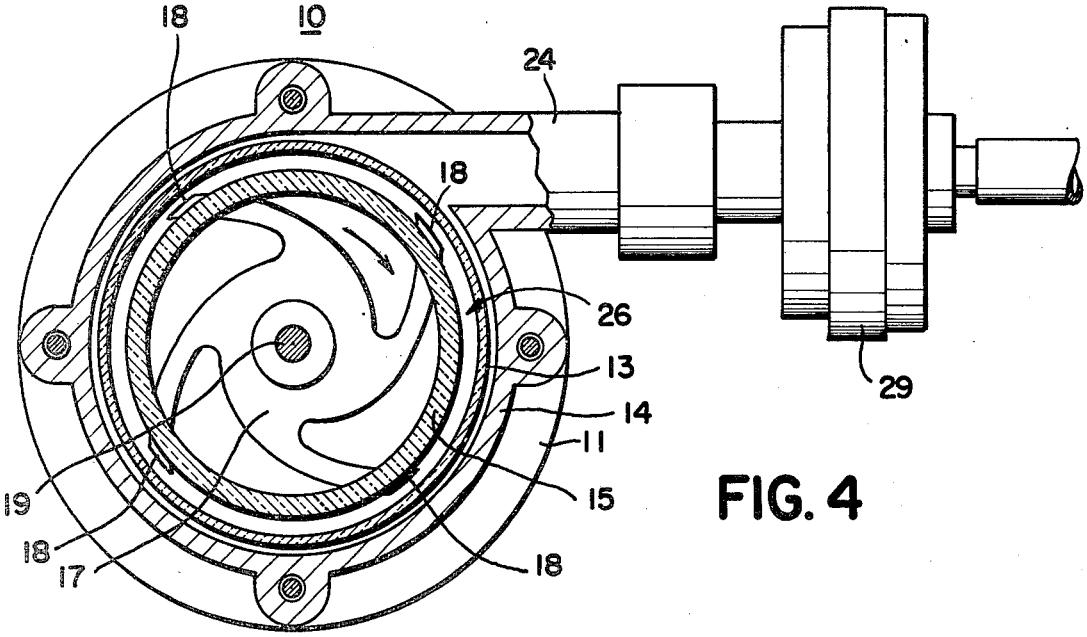
FIG. 4 is a side elevational view, partly in section, of a portion of the apparatus of FIG. 1 taken along line 3—3 in FIG. 1.

The lid 14 illustrated in FIGS. 1-3 has tangentially protruding therefrom an extension pipe 24. As is particularly apparent from FIG. 4, this extension 24 opens into the outer cylinder 13. Consequently, liquid flowing through pipe extension 24 toward outer cylinder 13 (i.e., in the direction of arrow 25 in FIG. 4) is introduced into the annular space 26 between inner and outer cylinders 15, 13.

In the lid 14 illustrated in FIGS. 1-3 there is also provided a generally centrally located opening 30, providing a means for the passage of fluid from within inner cylinder 15 to the outside of the assembly 10. An outlet pipe 31 may be connected to this outlet opening 30, the remote end of this pipe leading to the intended destination of the fluids processed through unit 10 which may, for example, be one of the tanks of an automatic film developing machine.

There is shown in FIGS. 7-10 an alternative embodiment of the lid 14'. The lid 14' is provided with an outlet opening 30' which communicates with the inner cylinder 15 as previously described. In this embodiment the outlet 30' is positioned askew from the center of the lid 14'.

The lid 14' of FIG. 6 is also provided with a plurality of inlets 35 which communicate with the annular space 26 located between the inner and outer cylinders 15, 13. These inlets 35 may be combined to form a manifold which joins, for example, at a junction coupling 29, the purpose of which will be described below. In this manner, a fluid may be introduced into the annular space 26 with improved uniformity. It is also possible for the inlets 35 to be grouped together to form two or more manifolds, each of which is capable of introducing a separate fluid into the annular space 26, if desired.

Pumps 27, 28 (FIG. 1) have their outlets connected to tangential extension pipe 24 through a junction coupling 29. This coupling 29 may take any conventional form consisting of internal passages through which liquid can flow from the pumps 27, 28 toward pipe 24 but not in reverse. To that end, conventional one-way valves may be associated with the internal passages within junction coupling 29.

The pumps 27, 28 are preferably of the pulsating bellows variety illustrated and may be actuated, as previously stated, in the manner disclosed in our prior U.S. Pat. No. 3,965,758 issued June 27, 1976.

In operation, this system functions as follows.

The pumps 27 and 28 are respectively coupled to separate containers of the several fluids which are to be supplied in mixture as replenisher for our automatic film developing machine. For example, the fluid supplied to one of these pumps may be water, while the fluid supplied to the other pump is another component of the replenisher. Due to the functioning of pumps 27, 28, these fluids are then forced under pressure through junction coupling 29 and into pipe 24, and through that pipe into the annular space 26 defined between inner and outer cylinders 15, 13.

Assisted by gravity, the fluids thus received within this annular space 26 in due course reach the gap 16 which exists between the free end of inner cylinder 15 and base 12. These fluids then tend to flow radially inward through gap 16 into the cylindrical space defined within inner cylinder 15.

At the same time, however, impeller 17 is rotating under the drive of motor 11. The direction of the rotation of the motor 11 is preferably such that the blades of impeller 17 turn in the direction indicated by arrow 32 in FIG. 5. It will be recognized that rotation of this impeller, as described, will exert a centrifugal force upon the fluids seeking to pass from annular space 26 through gap 16 into the interior of cylinder 15. Thus, there will be in the general area of the impeller 17 two counteracting forces operating upon the fluids. One force will be that which tends to cause them to flow radially inward, while the other one is that which tends to cause them to flow centrifugally outward. This causes an intermingling and blending under intense pressure and movement of the fluids supplied respectively from pumps 27 and 28 both within the annular space 26 and as they ultimately reach the interior of cylinder 15. The fluids so blended and still retaining to some degree the mingling and circulating action impressed upon them in the region of impeller 17 then continue to rise within inner cylinder 15 and ultimately are discharged from assembly 10 through outlet 30 and outlet pipe 31.

We have found that this system provides a remarkably effective mixing and pumping action for fluids such as are needed to replenish the treatment tanks of automatic film processing machines.

The fluid inlets of pumps such as shown at 27, 28 in FIG. 1 may draw their respective fluids directly from the conventional storage or shipping containers of these fluids. There is no separate mixing container required. The system is completely closed and does not permit any spillage or involve "messy" handling, nor is there any loss of fluids during handling through the system.

A particularly desirable feature is that the system is self-purging of air, so that the harmful oxidation which occurs in the presence of air is strongly suppressed.

The mixtures produced and supplied through outlet pipe 31 are particularly satisfactory for use in automatic film developing machines. Their uniformity is very high and the tendency for their ingredients to separate out is very low.

The proportions of fluids in the mixture can be readily controlled through the operation of the pumps, such as shown at 27, 28.

Moreover, the use of pulsating type pumps, such as the bellows type pumps 27 and 28 is particularly desirable in the present system for the following reasons. The resulting pulsating flow of fluid into the gap 16 within unit 10 causes a pulsating variation in local conditions within the fluid within this gap which, we have found, further contributes to the thorough, intimate and uniform mixing of these fluids. This pulsating effect also tends to cause some variation in the speed of rotation of the impeller 17, which tends to slow down as a fluid impulse is felt in its vicinity, while speeding up as the fluid impulse diminishes. This variation in impeller speed further enhances the intimacy of mixing.

It will be understood that many variations are possible without departing from the scope of the invention. For example, the dimensions of the equipment will be adapted to the particular requirement of flow rate and other quantitative parameters.

A magnetically driven impeller is shown to prevent the need for a rotating seal where the motor shaft drives the impeller. However, such a magnetic coupling is not essential.

Bellows type pumps have been shown but other types may be used instead.

Two pumps 27, 28 have been shown but larger numbers may be used if more than two ingredients are to be mixed at a given time. In that case, all of their outputs may be connected to the same inlet pipe 24 and through it to assembly 10.

In the embodiment shown, the impeller 17 is dimensioned with its blades 18 extending approximately to the perimeter of inner cylinder 15. However, depending upon requirements, these blades may extend radially outward by greater or lesser distances. Also the axial dimensions of the blades may be varied, and so may the gap 16 defined by the axial length of inner cylinder 15. The number of blades 18 and their specific curvature shapes may also be varied.

In addition to varying the curvature of the blades 18 illustrated, it is also possible to provide blades 18 having a complex curvature. Such blades 18 could, for example, have an additional curved portion along their top edge or at their outermost end, the curved portion extending inwardly or outwardly to further guide and direct the fluids between the outer cylinder 13 and the inner cylinder 15.

It is also possible to provide additional blades (not shown) which are fixed in position in the vicinity of the gap 16 and which further guide and direct fluid flow. Alternatively, a baffle plate (not shown) having openings therethrough, may be used. In both cases, these additional elements should not be positioned in a manner which restricts or impedes the advantageous effects produced by the rotating impeller 17 previously described.

The over-all dimension of the outer cylinder 13 may be adapted to the specific requirements of volume and flow rate of the fluids being mixed, and so may the radial dimension of the space between the inner and outer cylinders.

The cylinders are preferably both of transparent, or at least translucent material, for example an acrylic polymer, to enable observation of the mixing action. However, other materialas may be used if appropriate.

A further possible variation involves introducing the fluids to be mixed separately into the space between inner and outer cylinders.

Still another variation involves essentially inverting the arrangement of FIG. 1, so that the inlet 24 is at the bottom of this system, while the gap 16 and impeller 17 are at the top.

Ribs can be provided within the inner cylinder 15 or the outer cylinder 13, or both to assist in channelling the fluid flow.

Holes 43 can be provided in the wall of inner cylinder 15 to enable fluids to circulate therethrough, in addition to passing through gap 16, forming a fluid bypass through the wall of the inner cylinder 15, so long as the beneficial effects previously mentioned are not detracted from.

The system may further be provided with means for heating or cooling the fluids circulated through cylinders 13,15. For example, such means could be provided by placing a heating or cooling coil 44 in the base 12 of the motor housing, as illustrated in FIG. 2.

With respect to applications of the invention, these can include in addition to mixing of liquids, the mixing of fluids of which some are gaseous, and, of course, such applications are not confined to replenishment operations in automatic film developing machines.

We claim:

1. In a system for circulating and homogeneously mixing a plurality of fluids:

a cylindrical chamber having near one end an impeller rotatable about the axis of the chamber, an inner cylinder concentric within the chamber, which cylinder extends to the end of the chamber at the end remote from the impeller and defines an opening with the chamber at the end nearest the impeller, means for introducing the fluids into the annular space between the chamber wall and the inner cylinder to cause these fluids to flow inwardly into the inner cylinder in the region of the impeller, means for rotating the impeller to cause an alteration of the fluid at least in the region of the impeller, means for the passage of fluid from within the inner cylinder to the outside of the system, and whereby homogeneous mixing of the fluids is accomplished.

2. The system of claim 1 wherein the impeller has a plurality of curved, outwardly extending blades.

3. The system of claim 2 wherein the height of the blades of the impeller is less than the opening between the annular space and the inner cylinder.

4. The system of claim 3 wherein the radial extension of the blades is greater than the outer radius of the inner cylinder.

5. The system of claim 2 wherein the blades are substantially perpendicular to the radial axis of the impeller.

6. The system of claim 2 wherein the blades are askew from the radial axis of the impeller.

7. The system of claim 2 wherein portions of the surfaces of respective blades overlap radially.

8. The system of claim 2 wherein the radial extension of the blades is essentially less than the outer radius of the inner cylinder.

9. The system of claim 2 wherein the impeller is constructed so that the outward curvature of the blades is in a direction opposite to the direction of rotation of the impeller.

10. The system of claim 2 wherein the positioning of the blades of the impeller is adjustable.

11. The system of claim 2 wherein the outward curvature of the blades is substantially convex with respect to the axis of the impeller.

12. The system of claim 1 wherein the blades are substantially equal in length.

13. The system of claim 11 wherein the blades are substantially equal in height.

14. The system of claim 11, wherein the blades are substantially symmetrically placed about the impeller.

15. The system of claim 1 wherein the cylindrical chamber is transparent.

16. The system of claim 15 wherein the cylindrical chamber is formed of an acrylic polymer.

17. The system of claim 1 wherein the inner cylinder is transparent.

18. The system of claim 17 wherein the inner cylinder is formed of an acrylic polymer.

19. The system of claim 1 wherein the cylindrical chamber is hermetically sealed.

20. The system of claim 1 wherein the means for introducing the fluids into the annular space is at the end of the cylindrical chamber opposite to that which is provided with the impeller.

21. The system of claim 20 wherein the fluid introducing means is at the top of the cylindrical chamber.

22. The system of claim 20 wherein the fluid introducing means is adapted to draw the respective fluids directly from containers used to store the fluids.

23. The system of claim 1 wherein the means for the passage of fluids from within the inner cylinder to the exterior of the system comprises an opening which is axially concentric with the inner cylinder.

24. The system of claim 23 wherein the opening is located at the end of the inner cylinder opposite to that which is provided with the impeller.

25. The system of claim 24 wherein the opening is located at the top of the cylindrical chamber.

26. The system of claim 24 wherein the opening means is adapted to communicate with a treatment tank of an automatic film processing machine.

27. The system of claim 1 wherein the fluid passing means and the fluid introducing means are located at the same end of the cylindrical chamber.

28. The system of claim 1 wherein the fluid introducing means introduces fluids tangentially to the circumference of the annular space.

29. The system of claim 1 wherein the fluid introducing means comprises a plurality of inlets which communicate with the annular space.

30. The system of claim 29 wherein the plurality of inlets combine at a single junction forming a manifold, whereby a fluid may be uniformly introduced into the annular space.

31. The system of claim 29 wherein the inlets are grouped and positioned circumferentially symmetrically about the fluid introducing means.

32. The system of claim 31 wherein respective inlets located in each group of inlets combine at a single junction forming a plurality of manifolds, each of which is capable of uniformly introducing a fluid into the annular space.

33. The system of claim 31 which has grouped pairs of inlets.

34. The system of claim 29 wherein the fluid passing means is askew from the axis of the chamber.

35. The system of claim 1 wherein the fluid introducing means further comprises a one-way junction coupling which permits a plurality of initially separate fluids to jointly enter the annular space but precludes reverse flow of the fluids through the coupling.

36. The system of claim 1 further comprising heating means whereby fluids within the cylindrical chamber can be heated.

37. The system of claim 1 further comprising cooling means whereby fluids within the cylindrical chamber can be cooled.

38. The system of claim 1 wherein the means for rotating the impeller is a magnetically coupled motor.

39. The system of claim 1 further comprising a plurality of pumps connected to supply a plurality of fluids to the fluid introducing means.

40. The system of claim 39 wherein the pumps are pulsating pumps, whereby the pressure in the cylindrical chamber is subjected to pulsating variations.

41. The system of claim 1 further comprising a bypass through the wall of the inner cylinder whereby fluids may pass from the annular space to the inner cylinder without passing near the impeller.

42. A method for circulating a fluid and for homogeneously mixing a plurality of fluids within a mixing pump having a cylindrical chamber, one end of which is provided with a fluid introducing means and the other end of which is provided with an impeller, and an inner cylinder concentric with the cylindrical chamber, one end of which co-terminates with one end of the cylindrical chamber and the other end of which terminates at a point near the impeller but away from the end of the cylindrical chamber which is provided with the impeller, the impeller having blades which radially, outwardly extend with a substantially convex curvature, which method comprises introducing a plurality of fluids into the annual space defined between the cylindrical chamber and the inner cylinder, circulating the fluids within the annular space toward the area of the cylindrical chamber near the impeller, rotating the impeller in a direction opposing the direction of outward curvature of the blades, thus creating a centrifugal pumping action, thus creating a counteracting force which operates on the fluids in the vicinity of the impeller, thereby mixing the plurality of fluids in a homogeneous manner, while concurrently, permitting a predetermined amount of the homogeneously mixed plurality of fluids to pass from the annular space, through the opening defined between the inner cylinder and the cylindrical chamber, and into the central region defined by the inner cylinder, and exiting the fluids which have passed into the central region defined by the inner cylinder from the mixing pump, whereby a plurality of fluids may be homogeneously mixed for delivery and use elsewhere.

43. The method of claim 42 wherein the mixing of fluids is performed substantially in the absence of air.

44. The method of claim 42 wherein the fluids are substantially liquid.

45. The method of claim 42 wherein the fluids are a combination of a liquid and a gas.

46. The method of claim 42 which further comprises introducing a plurality of fluids into the mixing pump at the end opposing that which is provided with the impeller.

47. The method of claim 42 which further comprises exiting the mixed fluids from the end of the mixing pump opposing that which is provided with the impeller.

48. The method of claim 42 wherein the circulation of fluids within the annular space is assisted by gravity.

49. The method of claim 42 which further comprises introducing the plurality of fluids into the annular space under pressure.

* * * * *